US005889738A

United States Patent [19]

Huter

[11] Patent Number: 5,889,738

[45] Date of Patent: Mar. 30, 1999

[54] CLOCKWORK MOVEMENT COMPRISING A GUIDING TUBE BETWEEN A PLATE AND A BRIDGE

[75] Inventor: Marc Huter, Biel, Switzerland

[73] Assignee: Eta SA Fabriques d'Ebauches, Grenchen, Switzerland

[21] Appl. No.: 876,243

[22] Filed: Jun. 16, 1997

[30] Foreign Application Priority Data

Jun. 18, 1996 [FR] France ..... 96 07555

[51] Int. Cl.[6] ..... G04B 19/02

[52] U.S. Cl. ..... 368/220; 368/318; 368/322

[58] Field of Search ..... 368/220, 222, 368/321, 322

[56] References Cited

U.S. PATENT DOCUMENTS

| | | | |
|---|---|---|---|
| 4,125,994 | 11/1978 | Nakagawa et al. | 368/323 |
| 4,378,957 | 4/1983 | Malkin et al. | 368/300 |

FOREIGN PATENT DOCUMENTS

| | | | |
|---|---|---|---|
| 2 057 067 | 5/1971 | France . | |
| 1148493 | 12/1952 | Germany | 368/322 |
| 315371 | 8/1956 | Switzerland | 368/322 |
| 331599 | 7/1958 | Switzerland | 368/322 |
| 588 108 | 1/1976 | Switzerland . | |
| 1 459 287 | 12/1976 | United Kingdom . | |

*Primary Examiner*—Bernard Roskoski
*Attorney, Agent, or Firm*—Griffin, Butler, Whisenhunt & Szipl

[57] ABSTRACT

The invention concerns a clockwork movement comprising a lower plate (1) situated on the side of the dial (19), a bridge (2), an upper plate (3) and a rotary shaft (10) which passes through a guiding tube (15) mounted in the bridge (2) and the lower plate (1).

The tube (15) has two opposite shoulders (21, 26) which abut respectively against the bridge and the plate to maintain a determined gap between the latter. Three tubes of this type are preferably provided, corresponding to three shafts (10) which may be shafts of chronograph counter hands. At least one of the tubes (15) has an external bearing surface (22) which assures the positioning of a printed circuit board (24).

The invention applies to any type of watch, in particular to chronograph watches.

10 Claims, 2 Drawing Sheets

CLOCKWORK MOVEMENT COMPRISING A GUIDING TUBE BETWEEN A PLATE AND A BRIDGE

The present invention concerns a clockwork movement comprising a lower plate, a fixed bridge fixed to said plate, a fixed guiding tube having two ends mounted in respective orifices of said plate and of the bridge, and a rotary wheel shaft passing through an axial bore of the tube and guided by the latter.

Figure 2:
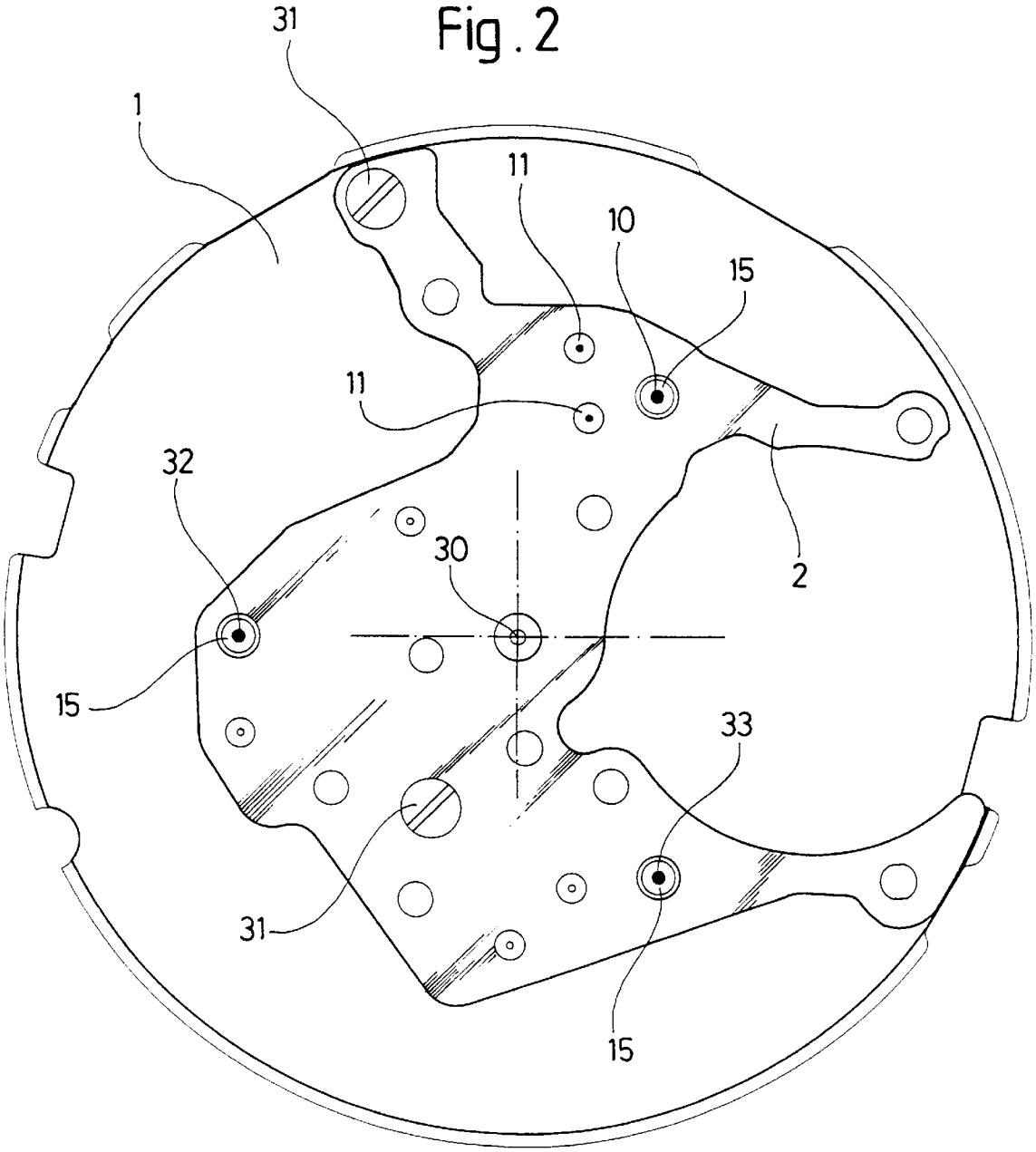

Using such a guiding tube to guide laterally a rotary shaft which passes through the plate and the bridge and which carries, for example, a hand below the plate (i.e. on the dial side) and a wheel above the bridge is known. Beyond such wheel, the end of the shaft is generally supported by a second bridge or a second plate. FIG. 2 of patent GB 1 459 287 illustrates an alternative wherein the tube is mounted in orifices of a bridge and a dial, at the centre of the dial, to guide the concentric shafts of the hour, minute and second hands.

In such conventional constructions, each bridge is fixed to the plate by means of screw pillars, generally three in number, which may also carry two bridges at different levels, as is shown for example by patent CH 588 108. These pillars have the disadvantage of having to be placed, in plane view, outside zones occupied by the wheels and pinions of the movement between the plate and the bridges. They are thus often placed close to the edges of the bridges and this may lead to an increase in the size, thickness and weight of the bridges. Any guiding tubes occupy other locations.

An aim of the present invention is to avoid the aforementioned drawback and to allow as compact and light as possible a design of the movement, in particular in the case of a complicated movement such as that of a chronograph watch.

The invention thus concerns a clockwork movement of the type indicated hereinbefore, characterised in that the tube comprises two external opposite shoulders abutting respectively against said plate and the bridge to maintain a determined gap between said plate and said bridge.

Thus, a basic idea of the invention consists in replacing at least one of the usual bridge pillars, and preferably several such pillars, by a special arrangement of one or more of the guiding tubes which are already situated in the space between the plate and the bridge. This results not only in an obvious space saving, but also a considerable reduction in the size and thus the weight of the bridge, in addition to the saving in pillar weight. Since the guiding tubes, which are usually three in number in chronograph watches, are at a certain distance from the edge of the plate, the distances between them are generally smaller than the distances between conventional pillars, so that the thickness of the bridge may be reduced in certain cases, or the bridge may be made more rigid. The bridge may be fixed to the plate simply by means of screws tending to grip the tubes between the plate and the bridge. Such screws require much less space than conventional pillars and their position may thus be chosen more freely.

The function of the two external shoulders of each guiding tube is to maintain a perfectly defined gap between the plate and the bridge, given that the shafts of wheels and pinions are usually mounted so as to pivot on these two elements. This problem and this function do not exist in the aforementioned construction according to patent GB 1 459 287, wherein the tube is fixed to the dial without the aid of a shoulder and there is no pivoting on the dial.

Figure 1:
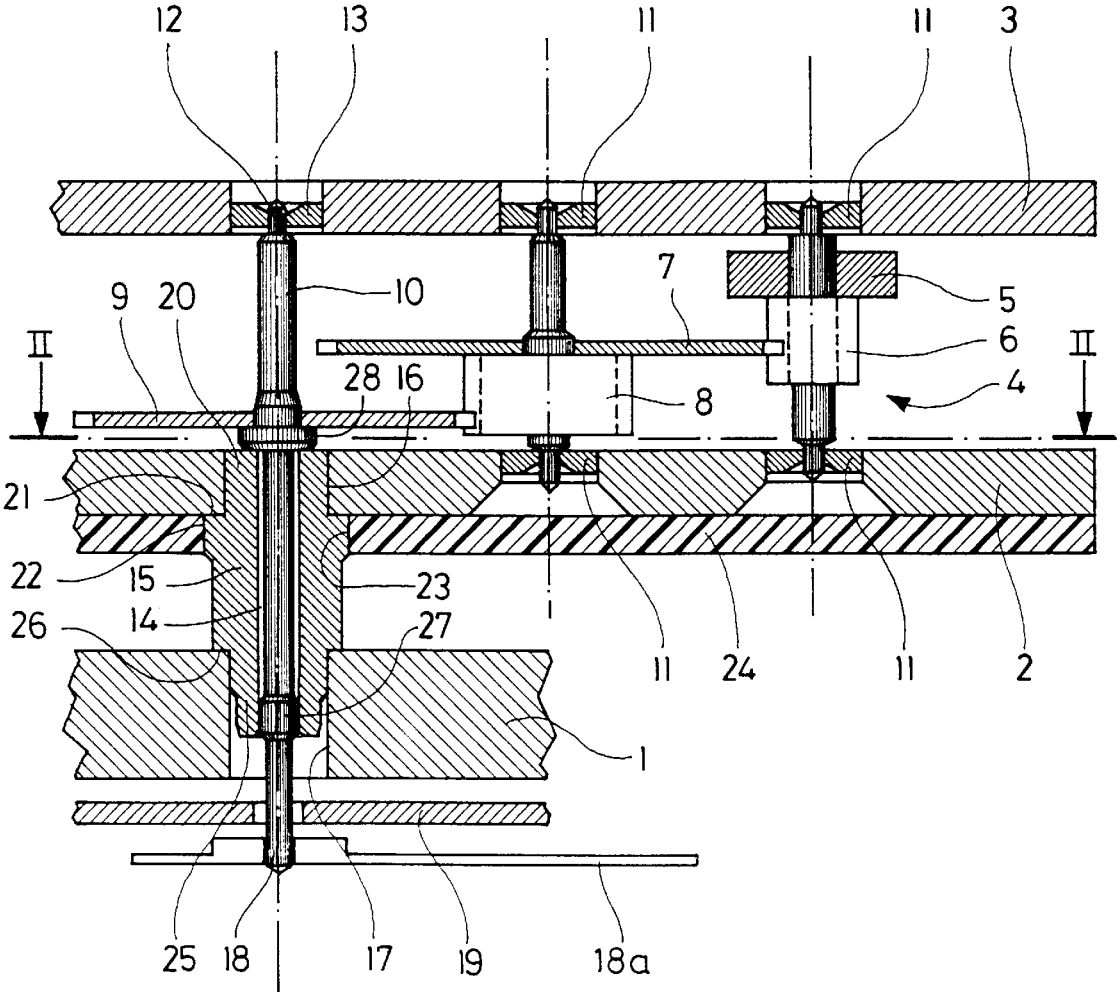

Other features and advantages of the present invention will appear in the description of a preferred embodiment, given hereinafter by way of non-limiting example, with reference to the attached drawings, in which:

FIG. 1 is a cross-section view of a part of a movement according to the invention, intended for a chronograph watch, and FIG. 2 is a simplified plane view of the gear-train bridge, along the line II—II of FIG. 1.

In FIG. 1, the movement is drawn with the dial situated towards the bottom, i.e. the term "lower" refers to something situated on the dial side, while the term "upper" refers to something situated on the opposite side.

The movement comprises in the conventional manner a lower plate 1, a gear-train bridge 2, an upper plate 3 and a gear-train 4 arranged between bridge 2 and plate 3. Gear-train 4 comprises here the rotor 5 of a stepping motor, attached to a pinion 6, a wheel 7 meshed on pinion 6 and attached to a pinion 8, and a wheel 9 meshed on pinion 8 and mounted on a shaft 10. The two wheels and pinions formed by elements 5 to 8 are supported by bridge 2 and upper plate 3 by means of bearings 11. The upper end of shaft 10 comprises a pivot 12 supported by a bearing 13 fixed in upper plate 3. Moreover, shaft 10 passes through a central bore 14 of a guiding tube 15 engaged in respective cylindrical orifices 16 and 17 of bridge 2 and lower plate 1, so that shaft 10 passes through bridge 2 and plate 1. Shaft 10 has a lower end 18 which also passes through dial 19 of the watch and carries a hand 18*a*. This hand may be for example the hand of a minute or hour counter of the chronograph. According to the usual arrangement, the counter is at a distance from centre 30 (FIG. 2) of the movement and of dial 19, this centre being occupied by the shafts of the hour and minute hands of the watch, and by the central hand of the chronograph.

A first end 20 of tube 15 is driven into corresponding orifice 16 of bridge 2, so that the tube is fixed to the bridge. Above this end 20, tube 15 has an annular frontal shoulder 21 which abuts bridge 2. This shoulder is followed by a cylindrical bearing surface 22 engaged in a hole 23 of a printed circuit board 24 placed against the lower face of bridge 2. Surface 22 is thus also used to position board 24 in its own plane, such board being further held against bridge 2 by struts (not shown) arranged between the board and plate 1.

Lower end 25 of tube 15 is engaged without play in orifice 17 of lower plate 1, where it is guided and able to be removed. Close to this end, tube 15 has an annular frontal shoulder 26 which abuts plate 1. Moreover, for example two screws 31 (FIG. 2) are provided, which pull bridge 2 towards plate 1 and thus tend to grip these two elements on shoulders 21 and 26 of tube 15, thereby assuring the stability of bridge 2 as in the conventional constructions mentioned hereinbefore.

Within bore 14 of tube 15, shaft 10 has a diameter which is slightly less than that of the bore, except on a cylindrical step 27 whose diameter corresponds to that of bore 14 to assure lateral guiding of the shaft. This step 27 is preferably situated in the zone of lower end 25 of the tube, i.e. as far as possible from opposite bearing 13. Shaft 10 further comprises a collar 28 which abuts first end 20 of tube 15 to assure its axial positioning. This collar is also used as a stop for wheel 9 driven onto the shaft.

In the chronograph movement described here, three shafts 10, 32 and 33 (FIG. 2) are provided, which pass through lower plate 1 and bridge 2, for example for three counters or for two counters and small second. Consequently, these shafts are guided by means of three guiding tubes 15, so that bridge 2 can be supported solely by these three tubes, which replace the conventional pillars and guarantee a precise gap between plate 1 and bridge 2. The resulting advantages are explained hereinbefore. Bridge 2 may also be supported by means of a combination of one or more guiding tubes and one or more conventional pillars.

Positioning of printed circuit board 24 may be assured by two of tubes 15 alone, corresponding orifice 23 of the board being circular around one of the tubes and elongated around the other to allow thermal expansion of the board.

It will further be noted that the invention may also apply to the case wherein there is no upper plate 3, since shaft 10 could be entirely supported by its guiding tube 15 or with the aid of other means.

Although the preceding description refers to a chronograph watch, the invention may also apply to any type of clockwork movement comprising a shaft which passes through both a bridge and a plate.

I claim:

1. A clockwork movement comprising a lower plate, a bridge fixed to said plate, a fixed guiding tube having two ends mounted in respective orifices of said plate and of said bridge, and a rotary wheel shaft passing through an axial bore of said tube and guided by the latter, wherein said tube comprises two opposite external shoulders abutting respectively against said plate and said bridge to maintain a determined gap between said plate and said bridge.

2. A clockwork movement according to claim 1, wherein a first end of said tube is driven into a corresponding one of said orifices, the other end being laterally guided in the other orifice.

3. A clockwork movement according to claim 2, wherein said first end is driven into the orifice of the bridge.

4. A clockwork movement according to claim 1, comprising a printed circuit element which is applied against said bridge and provided with a hole through which said tube passes, and wherein said tube has a peripheral bearing surface which co-operates with said hole to position said element.

5. A clockwork movement according to claim 1, wherein said shaft comprises a collar acting as an axial stop against said tube.

6. A clockwork movement according to claim 5, further comprising an upper plate arranged above said bridge and provided with a bearing supporting a pivot of said shaft.

7. A clockwork movement according to claim 1, wherein said shaft is that of a chronograph counter and bears a hand below said lower plate.

8. A clockwork movement according to claim 1, wherein said bridge is fixed to said lower plate by means of three of said tubes and screws tending to grip said tubes between said plate and said bridge.

9. A clockwork movement according to claim 1, comprising screw means to grip said tube between said plate and said bridge.

10. A clockwork movement comprising a plate, a bridge fixed to said plate, a stationary guiding tube having an axial bore and two opposite external shoulders, and a rotary wheel shaft extending through said axial bore and being guided by said tube, wherein two opposite ends of said tube are engaged in respective orifices of said plate and said bridge such that opposite external shoulders abut against said plate and said bridge, said plate and said bridge being fixed to each other by screw means such that said tube is gripped between said plate and said bridge.

* * * * *